US008584915B1

(12) United States Patent
Wang

(10) Patent No.: US 8,584,915 B1
(45) Date of Patent: Nov. 19, 2013

(54) HANGER PLATE FOR A TOOLBOX

(71) Applicant: Tzu-Chien Wang, Tainan (TW)

(72) Inventor: Tzu-Chien Wang, Tainan (TW)

( * ) Notice: Subject to any disclaimer, the term of this patent is extended or adjusted under 35 U.S.C. 154(b) by 0 days.

(21) Appl. No.: 13/673,585

(22) Filed: Nov. 9, 2012

(51) Int. Cl.
*A45F 5/00* (2006.01)

(52) U.S. Cl.
USPC ..... 224/197; 224/269

(58) Field of Classification Search
USPC ..... 224/197, 242, 268, 269, 666, 667, 669, 224/677
See application file for complete search history.

(56) References Cited

U.S. PATENT DOCUMENTS

| | | | | |
|---|---|---|---|---|
| 5,597,102 | A * | 1/1997 | Saarikko et al. | 224/197 |
| 5,988,577 | A * | 11/1999 | Phillips et al. | 248/231.81 |
| 6,269,993 | B1 * | 8/2001 | Ebejer et al. | 224/674 |
| 6,817,499 | B2 * | 11/2004 | Martinez | 224/197 |
| 6,955,279 | B1 * | 10/2005 | Mudd et al. | 224/197 |
| 6,966,519 | B2 * | 11/2005 | Salentine et al. | 242/379 |
| 7,188,726 | B2 * | 3/2007 | Lin | 206/373 |
| 7,216,788 | B2 * | 5/2007 | Blechman | 224/162 |
| 7,458,489 | B1 * | 12/2008 | Mudd et al. | 224/197 |
| 7,464,908 | B2 * | 12/2008 | Files | 248/229.16 |
| 7,478,776 | B2 * | 1/2009 | Salentine et al. | 242/379 |
| 7,900,771 | B1 * | 3/2011 | Meng | 206/379 |
| 8,109,420 | B2 * | 2/2012 | Martinez | 224/197 |
| 8,333,310 | B2 * | 12/2012 | Tages | 224/197 |
| 8,356,736 | B2 * | 1/2013 | Musgrave | 224/197 |
| 8,508,921 | B2 * | 8/2013 | Su | 361/679.01 |
| 2003/0218036 | A1 * | 11/2003 | Collins | 224/269 |
| 2005/0199522 | A1 * | 9/2005 | Hu | 206/373 |
| 2007/0114150 | A1 * | 5/2007 | Lin | 206/372 |
| 2008/0149678 | A1 * | 6/2008 | Huang | 224/666 |
| 2012/0144629 | A1 * | 6/2012 | Wang | 24/459 |

* cited by examiner

*Primary Examiner* — Nathan J. Newhouse
*Assistant Examiner* — Lester L Vanterpool

(57) ABSTRACT

A hanger plate is mounted by a hook to a toolbox. The hook is mounted to a protrusion on a side of the toolbox and includes two flexible plates defining a compartment. The hanger plate includes a hole, a hanger hole, and a slot between the hole and the hanger hole. The protrusion is received in the hole. A channel extends from the hole to the slot. A spacing between two lateral walls of the slot is larger than a width of the hook. A bridge extends from one of the lateral walls to the other lateral wall. The hook is engaged with the hanger plate, with the bridge received in the compartment, with a top wall of the slot located between a top edge of the hook and the hanger hole, with the hanger hole located outside of a length of the side of the body of the toolbox.

3 Claims, 7 Drawing Sheets

HANGER PLATE FOR A TOOLBOX

BACKGROUND OF THE INVENTION

The present invention relates to a hanger plate and, more particularly, to a hanger plate that can be mounted to a toolbox for hanging purposes.

To allow easy carriage of a toolbox receiving various tools, a hook is mounted to a side of a toolbox. With reference to FIG. 7, a hook 2' is provided to a side of a body 1' of a toolbox. The hook 2' is flexible and includes an opening 21' adjustable by flexing the hook 2'. The hook 2' can be engaged with a belt 3' of a user for carriage of the toolbox.

However, the hook 2' can not be used to hang the toolbox in a fixed position. Furthermore, use of the hook 2' is limited by the length of the belt 3'. Although the hook 2' can include a slot 22', the toolbox can not be hung if the slot 22' is within a length of the side of the body 1'.

BRIEF SUMMARY OF THE INVENTION

An objective of the present invention is to provide a hanger plate that can be attached to a toolbox by a hook, wherein the hanger plate can be mounted according to a length of a body of the toolbox to allow easy hanging of the toolbox.

The present invention provides a hanger plate mounted by a hook to a toolbox including a body having a side with a protrusion. The hook is mounted to the protrusion and includes inner and outer flexible plates. Each of the inner and outer flexible plates has upper and lower ends, with the upper ends of the inner and outer flexible plates connected at a top edge, with a compartment defined between the inner and outer flexible plates and having an opening between the lower ends of the inner and outer flexible plates. The hanger plate includes an upper portion and a lower portion, with a hole defined in the lower portion, with a hanger hole defined in the upper portion. The protrusion is received in the hole. The hanger plate further includes a slot between the hole and the hanger hole, with the slot including top and bottom walls and two lateral walls. A channel extends from the hole to the slot. A spacing between the lateral walls is larger than a width of the hook. A bridge extends from one of the lateral walls to the other lateral wall. The hook is engaged with the hanger plate, with the bridge received in the compartment, with the top wall of the slot located between the top edge of the hook and the hanger hole, with the hanger hole located outside of a length of the side of the body of the toolbox.

Preferably, the bridge includes two abutment faces respectively at two ends of the bridge, and the outer flexible plate of the hook including two lateral edges abutting the abutment faces.

Preferably, the inner flexible plate of the hook includes a peg pivotably received in a pivotal hole of the protrusion. The peg includes a hook engaged in the pivotal hole, preventing disengagement of the peg from the pivotal hole.

The present invention will become clearer in light of the following detailed description of illustrative embodiments of this invention described in connection with the drawings.

DETAILED DESCRIPTION OF THE INVENTION

Figure 1:
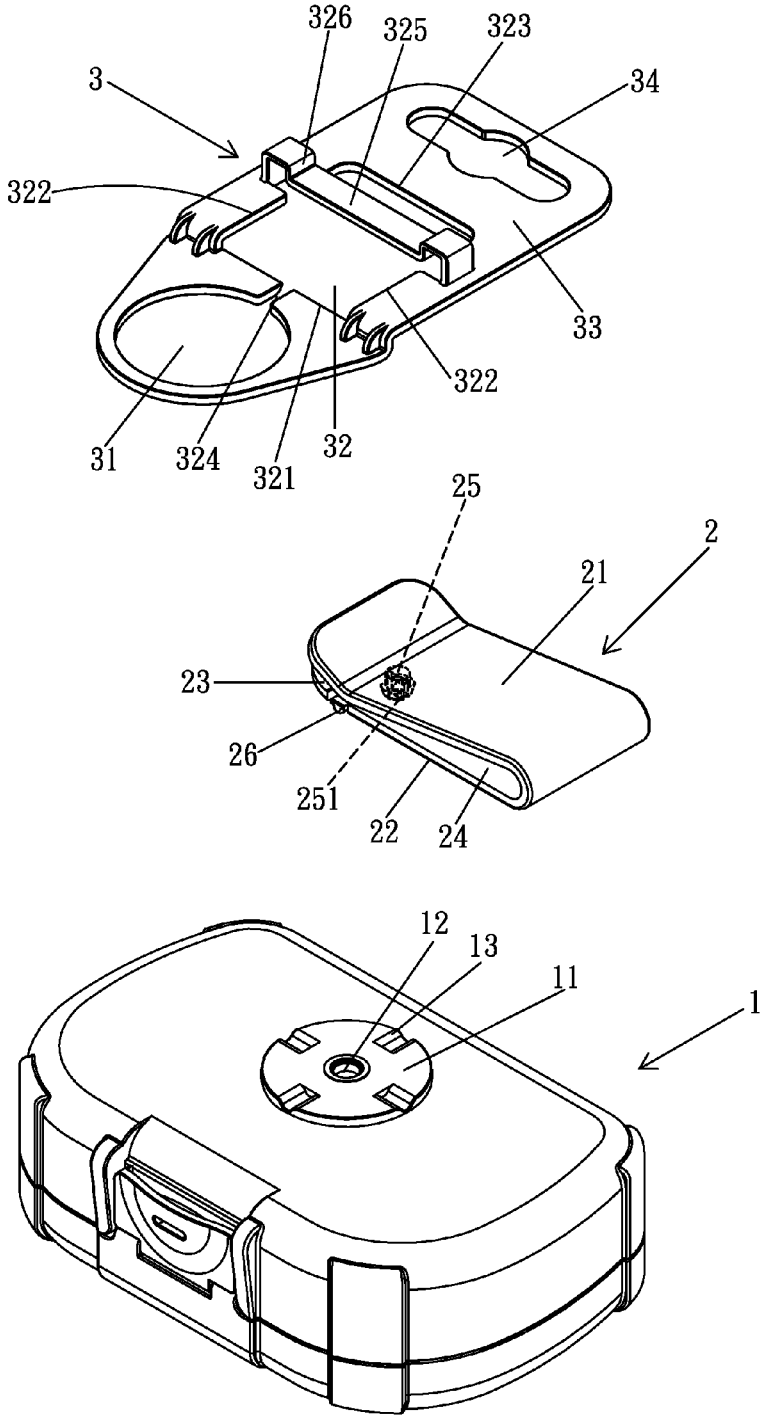
FIG. 1 shows an exploded, perspective view of a toolbox, a hook, and a hanger plate according to the present invention.

With reference to FIG. 1, a hanger plate 3 according to the present invention is mounted to a toolbox 1 by a hook 2. The toolbox 1 includes a body 1 having a side with a protrusion 11. The protrusion 11 of the body 1 includes a pivotal hole 12 and a plurality of positioning grooves 13.

The hook 2 is mounted to the protrusion 11 and includes inner and outer flexible plates 21 and 22 each having upper and lower ends, with the upper ends of the inner and outer flexible plates 21 and 22 connected at a top edge, with a compartment 24 defined between the inner and outer flexible plates 21 and 22 and having an opening 23 between the lower ends of the inner and outer flexible plates 21 and 22. The inner flexible plate 22 of the hook 2 includes a peg 25 pivotably received in the pivotal hole 12. The peg 25 includes a hook 251 engaged in the pivotal hole 12, preventing disengagement of the peg 25 from the pivotal hole 12. The inner flexible plate 22 includes a resilient positioning member 26 engaged with one of the positioning grooves 13 to retain the hook 2 in a desired angular position relative to the body 1 of the toolbox.

The hanger plate 3 includes an upper portion 33 and a lower portion. A hole 31 is defined in the lower portion, and a hanger hole 34 defined in the upper portion 33. The protrusion 11 of the body 1 of the toolbox is received in the hole 31. The hanger plate 3 further includes a slot 32 between the hole 31 and the hanger hole 34. The slot 32 includes top and bottom walls 323 and 321 and two lateral walls 322. A channel 324 extends from the hole 31 to the slot 32. A spacing between the lateral walls 322 is larger than a width of the hook 2. A bridge 325 extends from one of the lateral walls 322 to the other lateral wall 322. The bridge 325 includes two abutment faces 326 respectively at two ends of the bridge 325.

Figure 2:
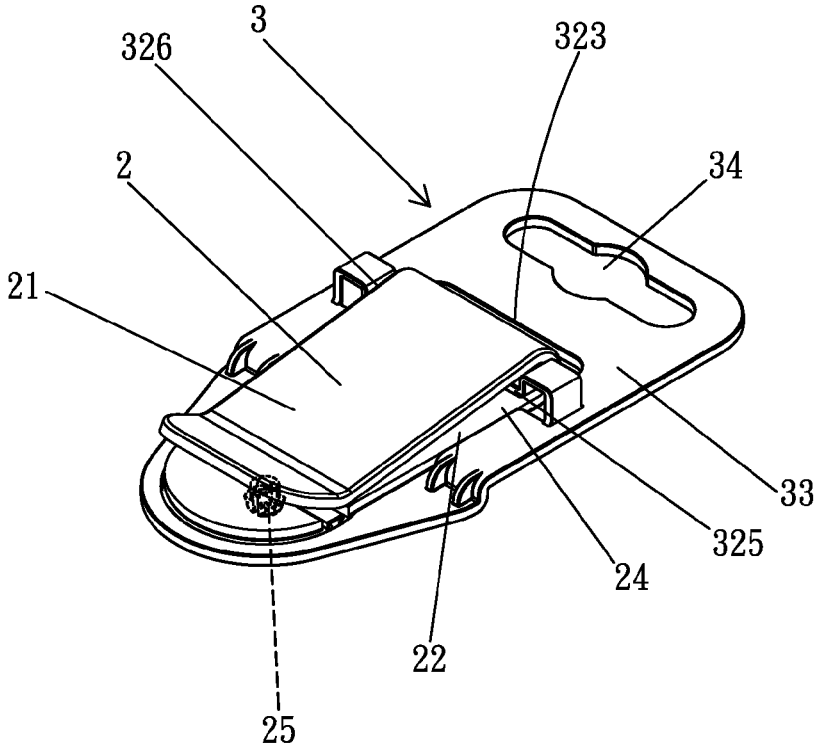
FIG. 2 shows a perspective view of the hanger plate and the hook after assembly.

With reference to FIG. 2, the hanger plate 3 is engaged with the hook 2, with the bridge 325 received in the compartment 24, with the top wall 323 of the slot 32 located between the top edge of the hook 2 and the hanger hole 34, with the peg 25 of the hook 2 located in the hole 31 of the hanger plate 3.

Figure 3:
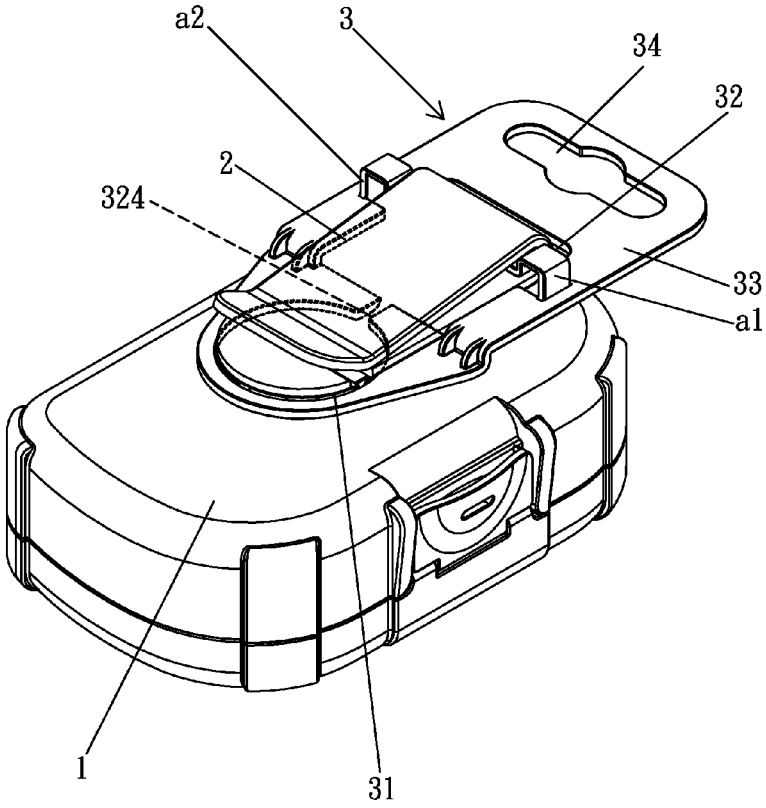
FIG. 3 is a perspective view of the toolbox, the hook, and the hanger plate after assembly.
Figure 4:
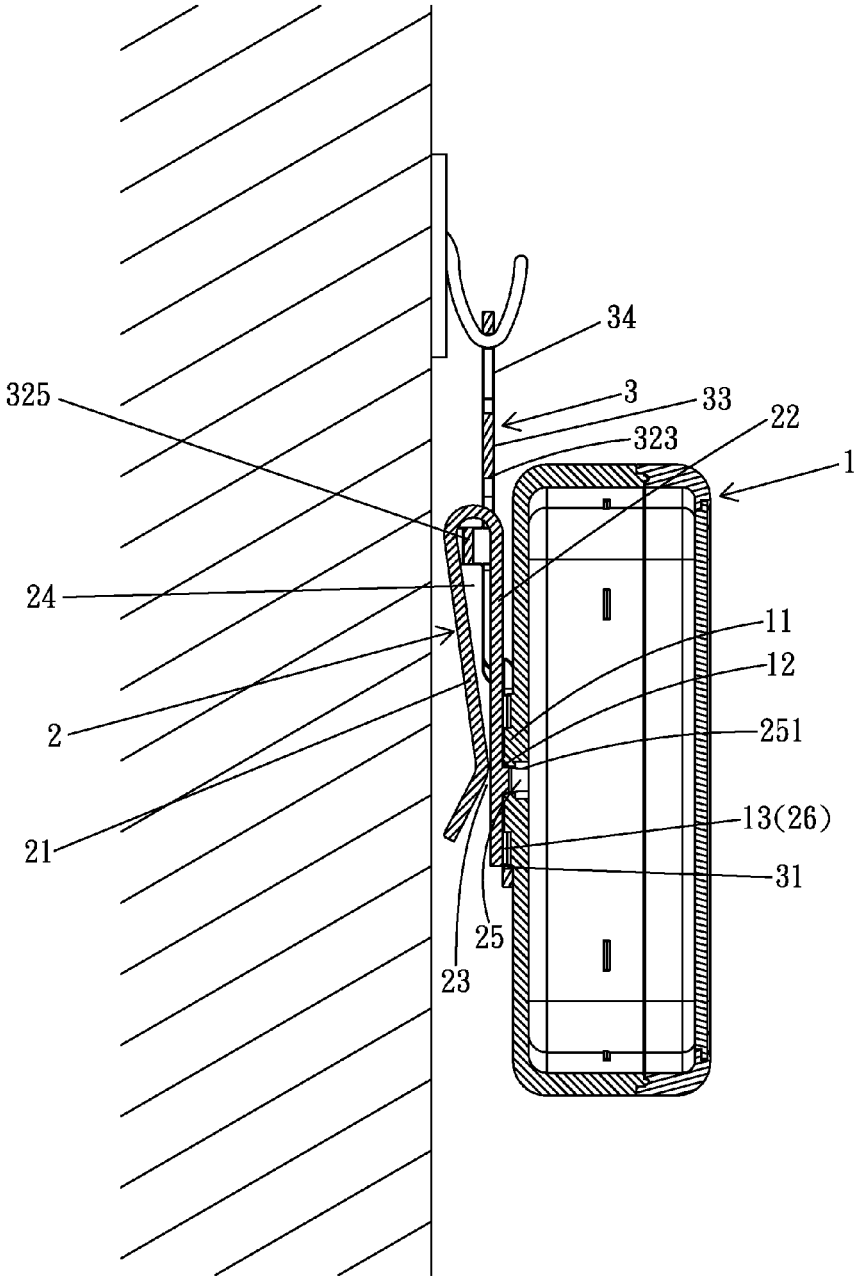
FIG. 4 shows a cross sectional view of the toolbox, the hook, and the hanger plate hung on a wall.
Figure 5:
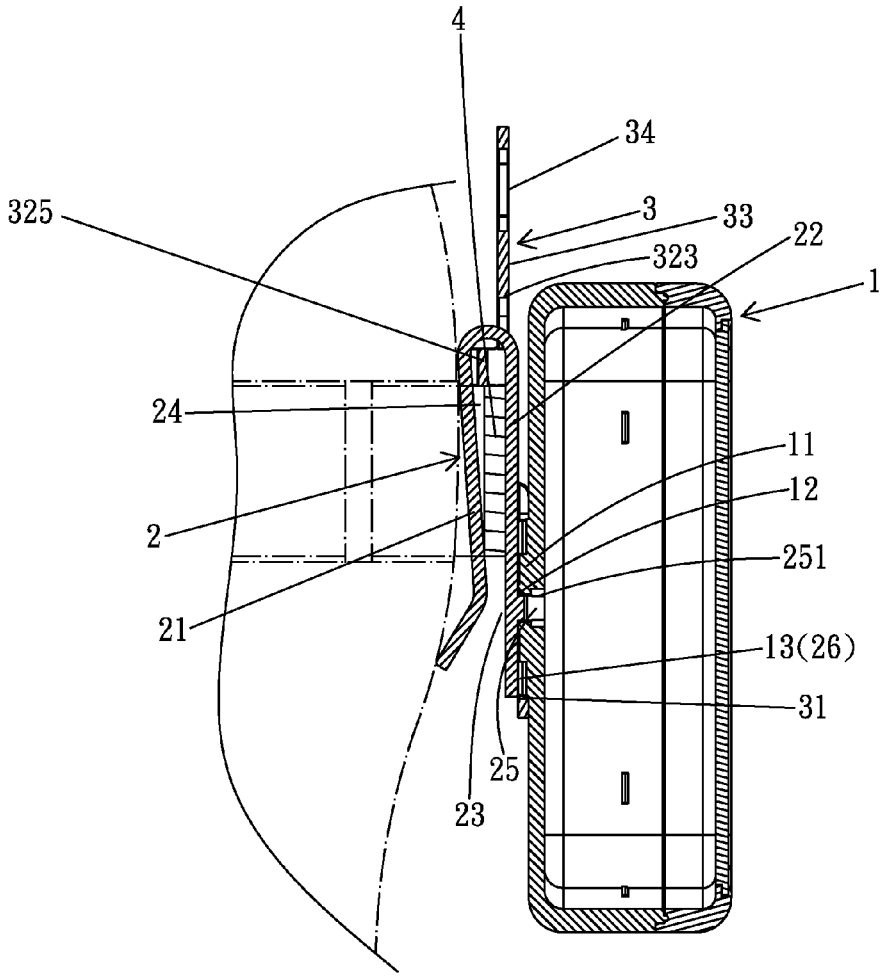
FIG. 5 shows a cross sectional view of the toolbox, the hook, and the hanger plate attached to a belt.

With reference to FIGS. 3 and 4, the peg 25 of the hook 2 is pivotably engaged with the pivotal hole 12 of the body 1 of the toolbox, with the protrusion 11 of the body 1 received in the hole 31 of the hanger plate 3, with the bridge 325 of the hanger plate 3 received in the compartment 24 of the hook 2, preventing disengagement of the hanger plate 3. The hanger hole 34 is located outside of a length of the side of the body 1 of the toolbox, allowing easy hanging of the toolbox. With reference to FIG. 5, the hook 2 can be hooked on a belt 4 of a user, allowing easy carriage.

Figure 6:
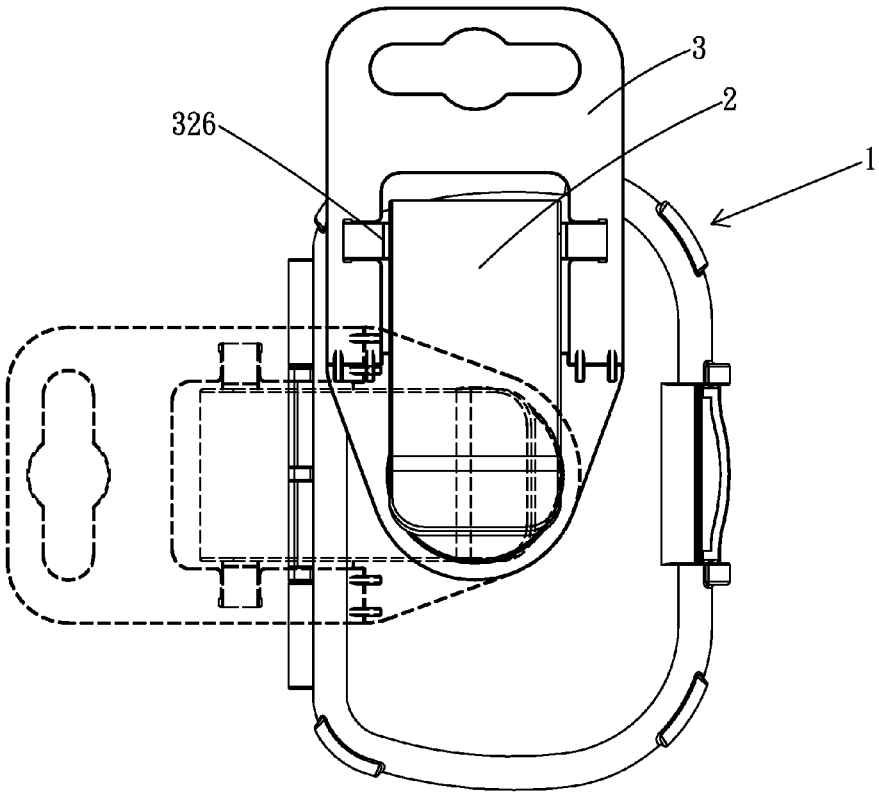
FIG. 6 shows a side view of the toolbox, the hook, and the hanger, with the hanger plate and the hook rotated 90°.
Figure 7:
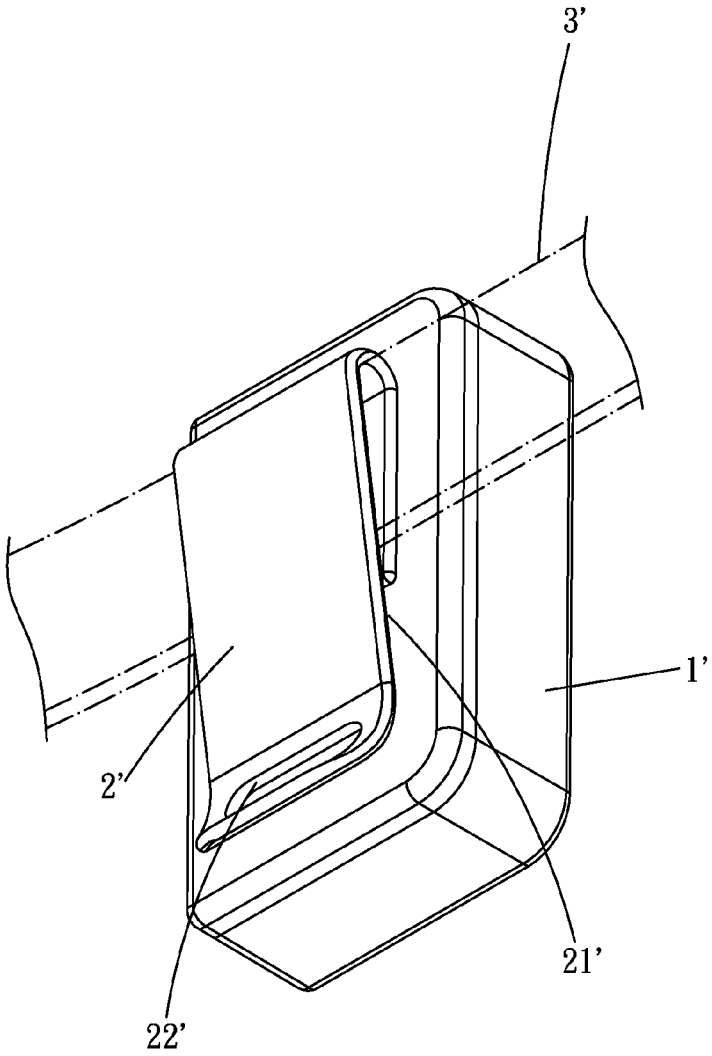
FIG. 7 shows a perspective view of a conventional toolbox with a hook.

With reference to FIG. 6, the body 1 of the toolbox can be rotated relative to the hook 2. Since two lateral edges of the outer flexible plate 21 of the hook 2 abutting the two abutment faces 326 of the hanger plate 3, the relative position between the hanger plate 3 and the hook 2 remains unchanged, preventing wobbling or rotation of the hanger plate 3 and, thus, providing enhanced stability in assembly. Thus, the present invention provides a combination of a hanger plate 3, a hook 2, and a toolbox allowing easy carriage and easy hanging.

When it is not desired to use the hanger plate 3, the bridge 325 of the hanger plate 3 can be cut off by the locations indicated by a1 and a2. The channel 324 can be expanded to allow removal of the hanger plate 3 from the hook 2 via the slot 32.

The upper portion 33 of the hanger plate 3 can be varied according to the length of the body 1 of the toolbox, assuring the hanger hole 34 to be located outside the length of the side of the body 1. Furthermore, patterns for labeling purposes can be provided on the upper portion 33.

If desired, the hook 2 can be fixed relative to the body 1 of the toolbox.

Although specific embodiments have been illustrated and described, numerous modifications and variations are still possible without departing from the essence of the invention. The scope of the invention is limited by the accompanying claims.

The invention claimed is:

1. A combination comprising:

a toolbox including a body having a side with a protrusion;

a hook mounted to the protrusion, with the hook including inner and outer flexible plates, with each of the inner and outer flexible plates having upper and lower ends, with the upper ends of the inner and outer flexible plates connected at a top edge, with a compartment defined between the inner and outer flexible plates and having an opening between the lower ends of the inner and outer flexible plates; and a hanger plate including an upper portion and a lower portion, with a hole defined in the lower portion, with a hanger hole defined in the upper portion, with the protrusion received in the hole, with the hanger plate further including a slot between the hole and the hanger hole, with the slot including top and bottom walls and two lateral walls, with a channel extending from the hole to the slot, with a spacing between the two lateral walls larger than a width of the hook, with a bridge extending from one of the two lateral walls to another of the two lateral walls, with the hook engaged with the hanger plate, with the bridge received in the compartment, with the top wall of the slot located between the top edge of the hook and the hanger hole, with the hanger hole located outside of a length of the side of the body of the toolbox.

2. The combination as claimed in claim 1, with the bridge including two abutment faces respectively at two ends of the bridge, with the outer flexible plate of the hook including two lateral edges, with the two lateral edges abutting the two abutment faces.

3. The combination as claimed in claim 1, with the protrusion of the body including a pivotal hole, with the inner flexible plate of the hook including a peg pivotably received in the pivotal hole, with the peg including a hook engaged in the pivotal hole, preventing disengagement of the peg from the pivotal hole.

* * * * *